US006914581B1

(12) United States Patent
Popek

(10) Patent No.: US 6,914,581 B1
(45) Date of Patent: Jul. 5, 2005

(54) FOCUSED WAVE ANTENNA

(75) Inventor: Marc H. Popek, Las Vegas, NV (US)

(73) Assignee: Venture Partners, Reno, NV (US)

( * ) Notice: Subject to any disclaimer, the term of this patent is extended or adjusted under 35 U.S.C. 154(b) by 0 days.

(21) Appl. No.: 10/286,129

(22) Filed: Oct. 31, 2002

Related U.S. Application Data

(60) Provisional application No. 60/336,028, filed on Oct. 31, 2001.

(51) Int. Cl.[7] ..... H01Q 15/02; H01Q 15/24

(52) U.S. Cl. ..... 343/909; 343/756; 343/873

(58) Field of Search ..... 343/909, 756, 343/793, 795, 700 MS, 873; H01Q 15/02, 15/24

(56) References Cited

U.S. PATENT DOCUMENTS

| | | | | | |
|---|---|---|---|---|---|
| 4,725,395 | A | * | 2/1988 | Gasparaitis et al. | 343/895 |
| 5,231,412 | A | * | 7/1993 | Eberhardt et al. | 343/790 |
| 5,528,254 | A | * | 6/1996 | Howng et al. | 343/873 |
| 5,592,184 | A | * | 1/1997 | Cassel et al. | 343/752 |
| 5,900,847 | A | * | 5/1999 | Ishikawa et al. | 343/909 |
| 6,154,179 | A | * | 11/2000 | Kohno | 343/719 |
| 6,324,974 | B1 | * | 12/2001 | Pomeroy et al. | 101/147 |
| 6,400,324 | B1 | * | 6/2002 | Macias | 343/702 |
| 6,424,318 | B1 | * | 7/2002 | Bergstedt et al. | 343/911 R |
| 6,480,157 | B1 | * | 11/2002 | Palmer et al. | 343/700 MS |
| 6,531,991 | B2 | * | 3/2003 | Adachi et al. | 343/873 |
| 2002/0149520 | A1 | * | 10/2002 | Laubner et al. | 343/700 MS |

OTHER PUBLICATIONS

The ARRL Antenna Book, 19th Edition, 2000–2002, Chapter 24, "Transmission Lines," pp. 24–3, 24–4.

Walker, William D., Experimental Evidence of Near–field Superluminally Propagating Electromagnetic Fields, PHYSICS, Aug. 21–25, 2000, pp. 1–17.

* cited by examiner

*Primary Examiner*—Hoanganh Le
(74) *Attorney, Agent, or Firm*—Miles & Stockbridge P.C

(57) ABSTRACT

Disclosed herein is an antenna that is integrally encompassed within a three-dimensional shaped substance that has a permittivity or permeability constant greater than one. Such an encompassed antenna results in the production of radiated energy at a particular frequency and gain that can conventionally only be produced by a larger antenna.

11 Claims, 9 Drawing Sheets

FOCUSED WAVE ANTENNA

CROSS-REFERENCE TO RELATED APPLICATIONS

This application claims the benefit of U.S. Provisional Application 60/336,028 filed Oct. 31, 2001 entitled Focused Wave Technology Antennas.

BACKGROUND

Within recent years, the demand for mobile and other radio frequency (RF) communications has increased dramatically. To service this demand, the need for effective antennas to broadcast the RF signals has also increased.

While antennas come in many forms, one of the most widely used antennas, especially for mobile communications, is the half-wave dipole. A brief description of these half-wave dipole antennas will be useful.

As shown in FIG. 1, a half-wave dipole 100 is a two pole antenna with two symmetrical equal length legs 102, 104. Each of the legs 102 and 104 is a quarter wavelength ($\lambda/4$) long, so that the entire length of the antenna is a half wavelength ($\lambda/2$).

A half-wave dipole forms a known and predictable radiation pattern as shown in FIG. 2A. The radiation pattern shown in FIG. 2A is shaped somewhat like a doughnut and radiates generally in all directions. FIG. 2B shows a two-dimensional cross sectional view of the radiation pattern in FIG. 2A, where such view is commonly used to evaluate antenna radiation patterns.

The half-wave dipole is generally preferred to other dipole lengths, (e.g., $\lambda/8$, $\lambda/4$, etc.), because of its superior radiation pattern. Further, it is the shortest resonant wave antenna and it includes a radiation resistance of 73 Ohm, which is near the 75 Ohm characteristic impedance of commonly used transmission lines, thereby simplifying impedance matching.

The wavelength of a signal produced by a half-wave dipole is generally described by the equation:

$$\lambda = \frac{c}{f},$$

where $\lambda$ is wavelength, c is the speed of light $3\times10^8$ m/s, and f is frequency. Hence, for a particular frequency, there is a known wavelength. Therefore the length ($\lambda/2$) of the half-wave dipole is generally dictated by the frequency to be transmitted. For example, a dipole to function at 6 GHz is will have a length of 25 mm ($\lambda$=50 mm), but a dipole that is to function at 3 GHz, will require a length of 50 mm ($\lambda$=100 mm). If adjustments are made to the antenna size without adjusting the frequency transmitted (for instance in an attempt to increase the antenna gain), the result is typically a less desirable radiation pattern.

Controlling the energy radiated (gain) and directivity of the radiation pattern is important. Increasing the gain is generally desirable as it will allow a signal to be received at further distances. A sample illustration of the radiation pattern from a dipole with increasing gain is shown in FIG. 3, illustrating radiation patterns for gains of 6 dBd, 3 dBd, and 5 dBd. Controlling the direction of focus of the radiated energy (the directivity) is also important—some applications require the radiated energy to be focused in a single direction while others require the energy to be more dispersed. Frequently, alterations to these two characteristics (gain and directivity) go hand-in-hand, e.g., focusing the signal in a particular direction will tend to increase the gain in that direction as well. Since the size of the antenna is not generally adjustable, other solutions to control these characteristics have been devised.

One solution is to form an array of antennas, arranged and spaced so that the energy radiated from each collectively adds together in a preferred direction and thereby increases the overall gain over that of a single antenna. Nonetheless, because of the use of multiple antennas, the size of such an array will tend to be larger than a single antenna.

Another solution for increasing gain and directivity is to use a reflective sheet 106 as shown in FIG. 4. When using a reflective sheet, the energy in one direction is reflected back and added to the energy generated in the opposite direction, resulting in increased gain. Such an antenna is generally spaced a quarter wavelength ($\lambda/4$) or longer (up to $3\lambda/8$) from the reflector surface so that the reflected wavefronts are in phase (the field at the reflective sheet experiences a 180 degree phase shift, which is added to the 180 degree phase shift the wave experiences traveling from and to the antenna).

While flat reflectors tend to enhance directivity by essentially blocking the energy in a 180 degree range, finer directivity control can be had with shaped reflectors, e.g., a parabolic dish. The shape of such reflectors aids in focusing the energy radiated in a desired pattern. While the parabolic dish offers good gain and directivity control, it tends to be physically quite large. For instance, at 2.4 GHz, a to obtain a 20 dBi gain, a 900 mm dish is used.

Another solution for control of gain and directivity is a dielectric lens, sometimes called a Luneberg lens. Such a dielectric lens is composed of a dielectric material and is placed a calculated distance measured in wavelengths in front of an antenna in its far field. The wavefront is shaped by the lens in accordance with physics similar to optical lens theory. Such lenses can be concave, dispersing energy, or convex, focusing energy. Nonetheless, these multi-element structures tend to be burdensome to construct as well as being large, so they are not commonly used.

In an attempt to create a small-scale antenna, a metal patch has been placed on top of a dielectric substrate. For example, at 2.4 GHz, a patch antenna on a ceramic dielectric can be as small as 22×22×4 mm. Nonetheless, these antennas are typically very inefficient and do not have desirable gain characteristics. Typically the gain of these antennas is −8 dBi.

Although numerous methodologies for controlling gain and directivity as described above exist, given the vast growth in radio frequency communication, improvements to these antennas are always desirable. Moreover, to meet the demand for smaller and smaller devices, any antenna that can maintain gain for a particular frequency yet be built in a smaller form factor is desirable.

SUMMARY

Disclosed herein is an antenna device in accordance with an embodiment of the invention designed to control directivity and gain while doing it in a smaller size than done conventionally. In particular a device in accordance with an embodiment of the invention can produce a signal having a particular frequency and gain in al much smaller form factor than a conventional device at the same frequency and gain. Moreover, use of a device in accordance with an embodiment of the invention allows selection of wavelength of the waveforms to be generated from a plurality of wavelengths while leaving frequency fixed. Therefore, wavelength is not determined solely by frequency.

More specifically, one embodiment of a device in accordance with the invention includes an antenna integrally encompassed in a shaped substance having a permittivity constant or a permeability constant greater than one. The substance chosen determines the wavelength that will be generated by the device at a particular fixed frequency. The shape of the substance is selected to focus, disperse, or otherwise shape the radiation pattern.

In some embodiments of the invention a reflector is also used to enhance gain and directivity. In some embodiments, the reflector is flat and placed at the base of the device while other embodiments use a shaped or split reflector to further control the shape of the radiation pattern.

BRIEF DESCRIPTION OF THE DRAWINGS

The present invention is described with respect to particular exemplary embodiments thereof and reference is accordingly made to the drawings (which are not necessarily drawn to scale) in which.

DETAILED DESCRIPTION

FIGS. 5–8 illustrate one embodiment of a device 600 in accordance with the invention. A device 600 in accordance with various embodiments of the invention is sometimes referred to herein as a Focused Wave Technology Antenna or an FWT antenna. As shown in FIGS. 5–8, a dipole, having legs 604, 606, is integrally encompassed within a shaped three-dimensional substance 602, which is a dielectric in some embodiments. By "integrally encompassed" in a substance is meant encased in or surrounded by the substance where there is negligible airspace between the substance and the antenna. By "negligible airspace" is meant that small voids or space up to $\lambda/16$ between the antenna and dielectric will be largely transparent to the performance of the FWT antenna and are acceptable in various embodiments.

Figure 6:
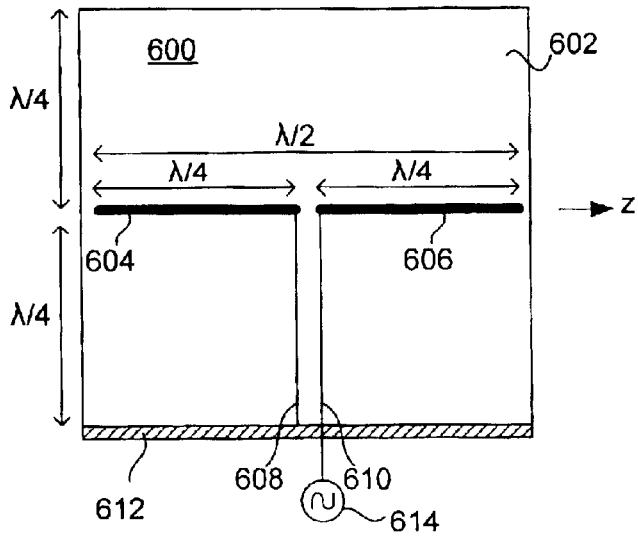
FIG. 6 is a front cutaway view of FIG. 5.

FIG. 6 is a front cutaway view of device 600 and shows the legs 604, 606 of the dipole that are each a quarter wavelength ($\lambda/4$) thereby forming a half-wave $\lambda/2$ antenna. The dipole is spaced a distance of approximately $\lambda/4$ from the base of substance 602 and $\lambda/4$ from the top of substance 602, although a range for each of these spacings of about $\lambda/4\pm\lambda/8$ will be suitable in other embodiments. Some embodiments may use even smaller dimensions but at a sacrifice to the radiation pattern. Transmission lines 608, 610, are also $\lambda/4$ ($\pm\lambda/8$) in length as a result of this spacing.

Figure 7:
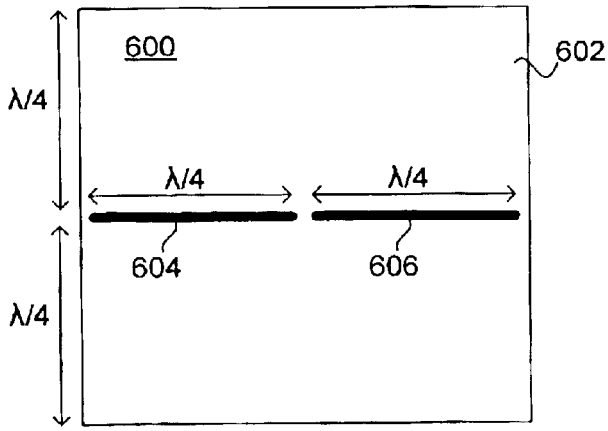
FIG. 7 is a top cutaway view of FIG. 5.

FIG. 7 illustrates a top cutaway view of the device 600. As shown, the dipole is also spaced approximately $\lambda/4$ from each of the front and rear side edges of substance 602. Spacing of other widths will be appropriate in some embodiments, although it may affect the radiation pattern generated. For instance, in some embodiments a total width from the front to the rear is $\lambda/4$ ($\lambda/8$ from the antenna to each edge), which will yield a radiation pattern with more rear leakage than one that has a $\lambda/2$ width.

Figure 8:
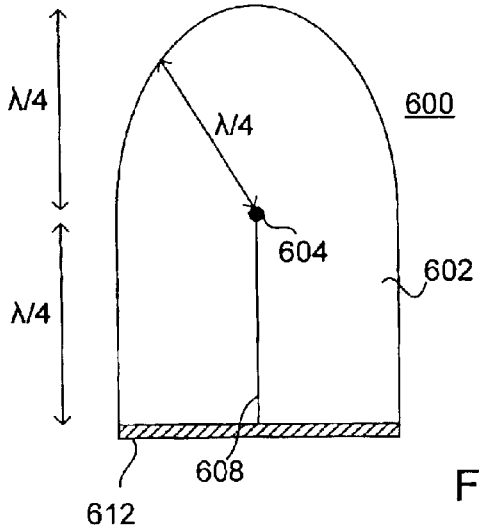
FIG. 8 is a side cutaway view:of FIG. 5.

FIG. 8 shows a side cutaway view of device 600 further illustrating the dimensions detailed above. The dipole is also radially spaced approximately $\lambda/4$ from the curvature in one embodiment although other spacings will be suitable in other embodiments but will affect the radiation pattern generated. For instance, in some embodiments a range of $\lambda/4\pm\lambda/8$ is tolerated. Other embodiments may use some smaller dimensions but at a possible sacrifice to the radiation pattern. Further, in a particular embodiment, the radial distance will vary over that range, e.g., the distance from the antenna to the top of the device may be $3\lambda/8$ while the distance to the base of the device is $\lambda/8$. Although it would increase the device size, any of these dimensions $n\lambda$ larger will also form a working device, where n is an integer (n=1,2, . . . N). In addition, as shown in FIGS. 6 and 7, while the ends of the dipole legs are covered with substance 602, that coverage is thin and need only be minimal. Accordingly, an FWT antenna in accordance with one embodiment of the invention has dimensions of approximately $\lambda/2$ length, $\lambda/2$ width, and $\lambda/2$ height, while other embodiments will have differing dimensions such as the ranges discussed above.

Substance 602 is sometimes referred to herein as a dielectric even though it should be understood that in some embodiments substance 602 may be a material that may not be classified as a dielectric. Hence, use of the term dielectric is merely for ease of description.

Although the equation $$\lambda = \frac{c}{f}$$

is usually used for determining wavelength, and hence the size of an antenna, for a particular frequency, the equation is more accurately written as $$\lambda = \frac{c}{f}\frac{1}{\sqrt{\varepsilon_R \mu_R}},$$

where $\in_R$ is a permittivity constant and $\mu_R$ is, a permeability constant. $\in_R$ is sometimes also referred to as a dielectric constant. For air, $\in_R$=1 and $\mu_R$=1, hence the equation as used in RF communications is usually abbreviated, eliminating reference to $\in_R$ and $\mu_R$ However, if an antenna is surrounded by a medium other than air, $\in_R$ and/or $\mu_R$ will change. If $\in_R$ or $\mu_R$ are greater than 1, the velocity of the wavefront is effectively slowed from c to:

$$\frac{c}{\sqrt{\varepsilon_R \mu_R}}$$

causing wavelength λ to be smaller while leaving the frequency fixed. Therefore, by choosing a substance with an $\in_R$>1 or a $\mu_R$>1, a device in accordance within an embodiment of the invention can produce a signal at a given frequency in a smaller space where that signal would normally be produced only by a larger antenna. In other words, an FWT antenna can be made with a shorter physical length than an equivalently performing conventional antenna while that FWT antenna will have an electrical length that is equivalent to that of the same conventional antenna. For instance, using as substance 602 a dielectric such as silicone having a dielectric constant $\in_R$ of approximately 4, an FWT antenna can be built at about half the size of its conventional counterpart:

For $\varepsilon_R = 4$, $\mu_R = 1$, $f = 2.4$ GHz, $$\lambda = \frac{c}{f}\frac{1}{\sqrt{\varepsilon_R \mu_R}} = \frac{3\times10^8}{2.4\times10^9}\frac{1}{\sqrt{4\cdot 1}} = 62.5 \text{ mm}$$

For $\varepsilon_R = 1$, $\mu_R = 1$, $f = 2.4$ GHz, $$\lambda = \frac{c}{f} = \frac{3\times10^8}{2.4\times10^9} = 125 \text{ mm}$$

Hence by choosing to integrally encompass the dipole antenna within a substance having an $\in_R$ or $\mu_R$ higher than unity will create an antenna with a relatively smaller size that can produce a signal comparable in wavelength and gain to a much larger antenna.

In transmission line design, the effects of dielectrics on wave velocity have been known. Dielectrics have been used to insulate transmission lines. Nonetheless, the thickness of such a dielectric insulator is much smaller than λ/8 of the signals carried by the transmission line. In transmission line design, a dielectric of any significant thickness would change the characteristics of the transmission line, causing it to become multi-mode. Accordingly, the dielectric thickness used in accordance with various embodiments of the invention, e.g., λ/4, is avoided in transmission line design.

Although Luneberg lenses have used dielectrics to enhance directivity, focusing or dispersing the radiation pattern, a Luneberg lens has always been placed in the "far field" of, the antenna as is understood in the art. Moving such a lens into the "near field" of the antenna has been avoided as it has been thought to result in the mistuning of an antenna and have deleterious effects on antenna performance. Nonetheless, a device in accordance with an embodiment of the invention places the dielectric in the near field by encompassing the antenna. As a result, the antenna virtually acts as though it were composed of the dielectric.

Conventionally, antennas are sometimes built with a protective structure about the antenna to protect the antenna, e.g., from the weather or from damage. Some have attempted to use a dielectric material surrounding the antenna as a protective structure. Nonetheless, these materials have been pumped full of air, causing air bubbles throughout the substance and causing the dielectric constant for the material surrounding the antenna to approximate that of air, $\in_R$=1. Accordingly, altering the dielectric constant of the substance surrounding the antenna away from $\in_R$=1 has not generally been viewed as good design.

Normally the size of a dipole antenna, including any protective elements, is a half wavelength in each linear dimension (length, width, and height). But when choosing to encapsulate a dipole in silicone ($\in_R$≅4) in accordance with an embodiment of the invention, each of the dipole antenna dimensions is reduced by a factor of 2, resulting in a reduced volume by a factor of 8. Obviously using other materials with a different dielectric will cause the volume to change by a different value.

Figure 9:
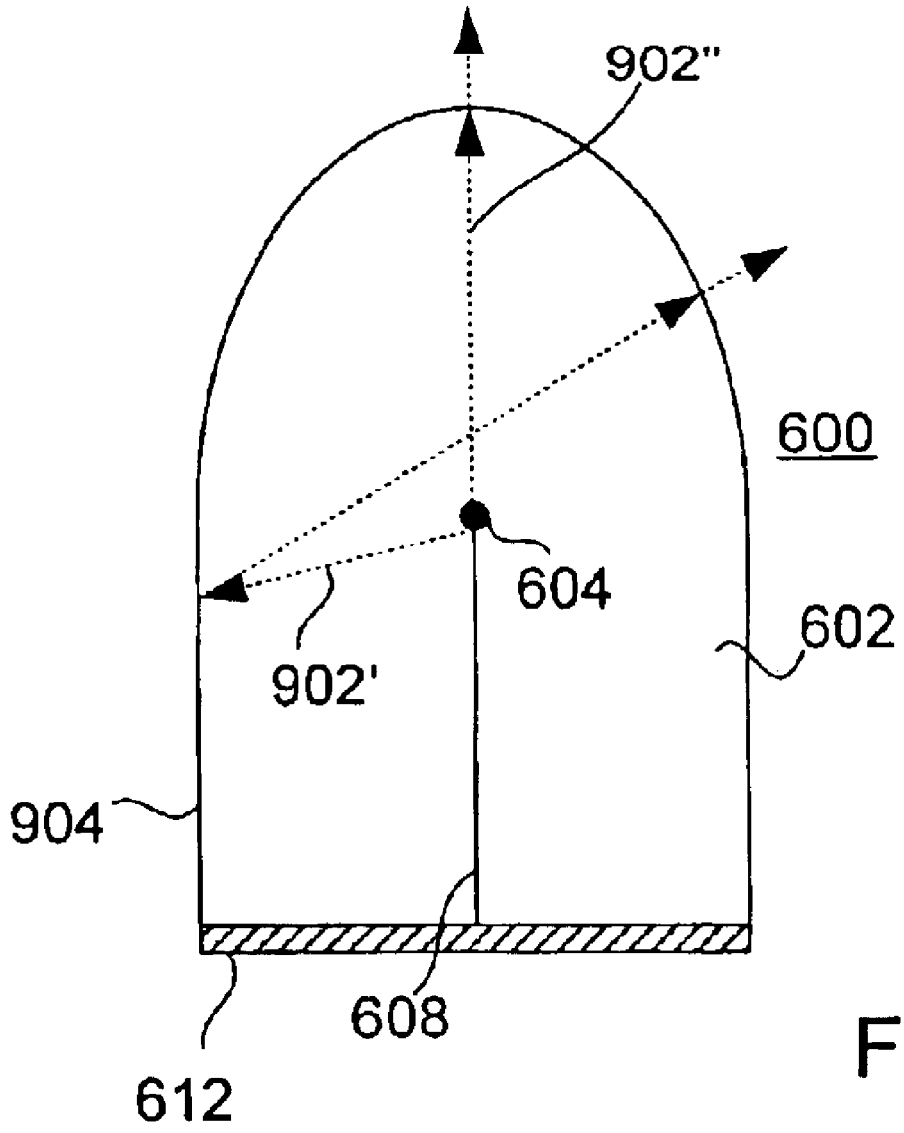
FIG. 9 is similar to FIG. 8 and further illustrates wave shaping in accordance with an embodiment of the invention.

In accordance with an embodiment of the invention, gain and directivity can be further controlled by shaping the substance encompassing the antenna. Shaping allows the wavefronts radiated from the antenna to be bent and redirected, taking advantage of the "optical ray" focusing effect, which is understood in the art. For instance, referring to FIG. 9, at certain angles of incidence, the radiated waves 902 are partially or wholly reflected at the dielectric/air boundary 904. At other angles of incidence, radiated waves 902" are mostly or wholly passed out of the dielectric at the dielectric/air boundary 904. Accordingly, the shape of the radiated energy can be chosen and varied by selecting various shapes for the dielectric (e.g., convex, concave, square, rounded, angular, or any shape desired). Thus, in choosing a substance, not only does one desire a dielectric constant where $\in_R$ (or $\mu_R$) is greater than 1, but also a substance that can be shaped. For instance, silicone may be an appropriate substance due to its dielectric constant ($\in_R$≅4) as well as its moldability properties. Other dielectrics that may be useful as a substance in which to encompass the antenna are glass ($\in_R$=7), mica ($\in_R$=3–6). mylar ($\in_R$=3.1), neoprene ($\in_R$=6.7), plexiglass ($\in_R$=3.4), polyethylene ($\mu_R$=2.35), polyvinyl chloride ($\in_R$=3.18), teflon ($\in_R$=2.1), ceramic ($\in_R$=10), and plastic. Some of these substances, e.g., glass, ceramic, will be moldable and formed at firing temperatures.

In addition, various liquids may also be suitable given that liquids are inherently shapeable. Such liquids are poured into a container of a selected shape with the antenna also placed inside. When the liquid is poured in the container, the liquid will take on the shape of the container and encompass the antenna. Suitable liquids may include deionized water ($\in_R$=86), oil, glycerine ($\in_R$=42.5), beeswax, or liquid ammonia ($\in_R$=25). In addition, use of liquids may lend itself to manufacturing where a preformed container could be filled with any of a plurality of liquids later, allowing for easy interchangeability of liquids with different $\in_R$'s or $\mu_R$'s to achieve the desired effect. In other words, the desired wavelength can be selected based on selection of the substance, whether the substance is liquid or solid.

Although several substances are listed above, the lists are not inclusive of all substances that may be suitable in all embodiments of the invention. Accordingly, a substance with which to encompass the antenna is chosen for its permittivity and/or permeability constants, its shapeability properties, its ability to work at the frequency of operation, and its non-corrosive properties.

Figure 1:
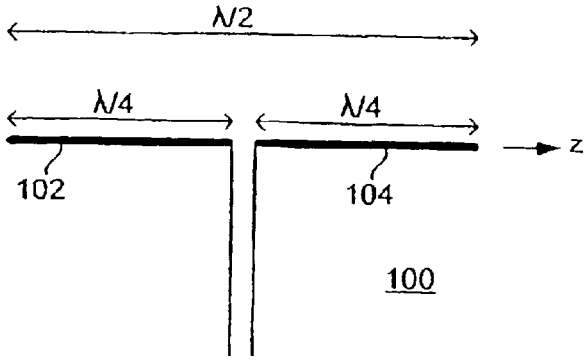
Fig. 1 PRIOR ART
FIG. 1 is a front diagrammatic view of a dipole antenna.
Figure 2A:
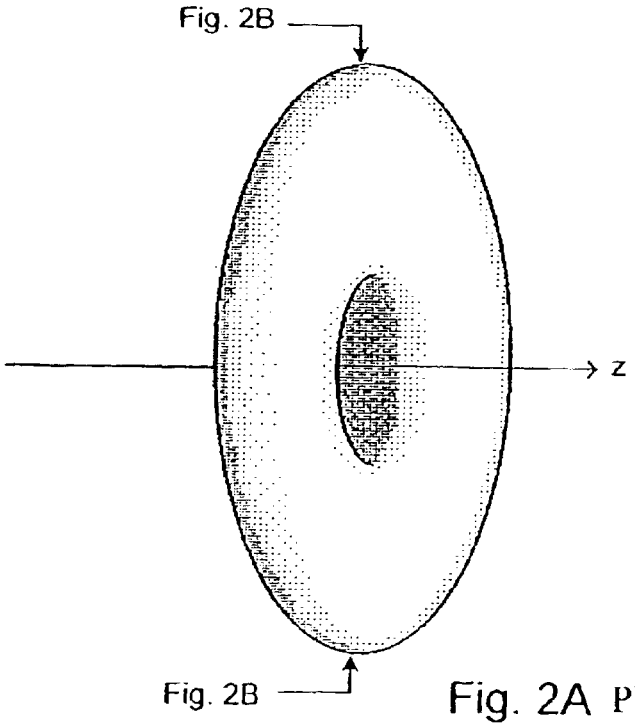
Fig. 2A PRIOR ART
FIG. 2A is a 3-dimensional view of a radiation pattern produced by a dipole.
Figure 2B:
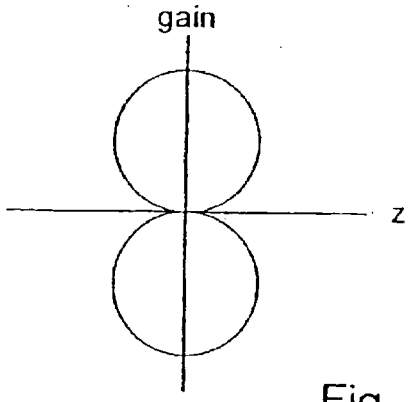
Fig. 2B PRIOR ART
FIG. 2B is a cutaway view of the radiation pattern of FIG. 2A.
Figure 3:
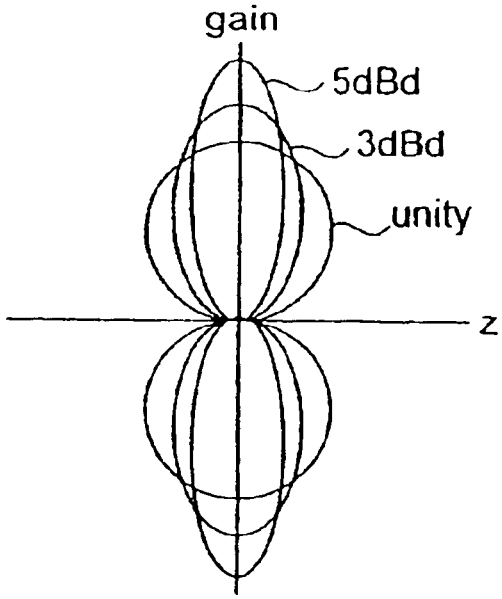
Fig. 3 PRIOR ART
FIG. 3 illustrates the radiation pattern for a dipole with increasing gain.
Figure 4:
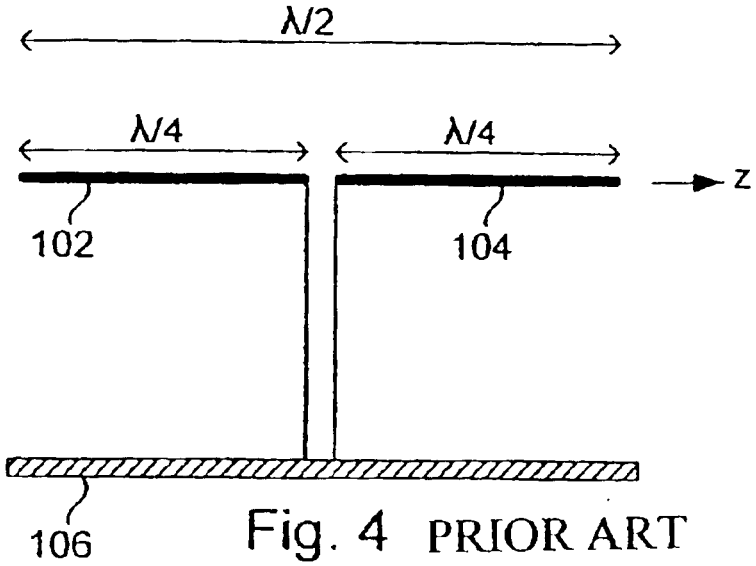
Fig. 4 PRIOR ART
FIG. 4 is a front diagrammatic view of a dipole with a reflector.
Figure 5:
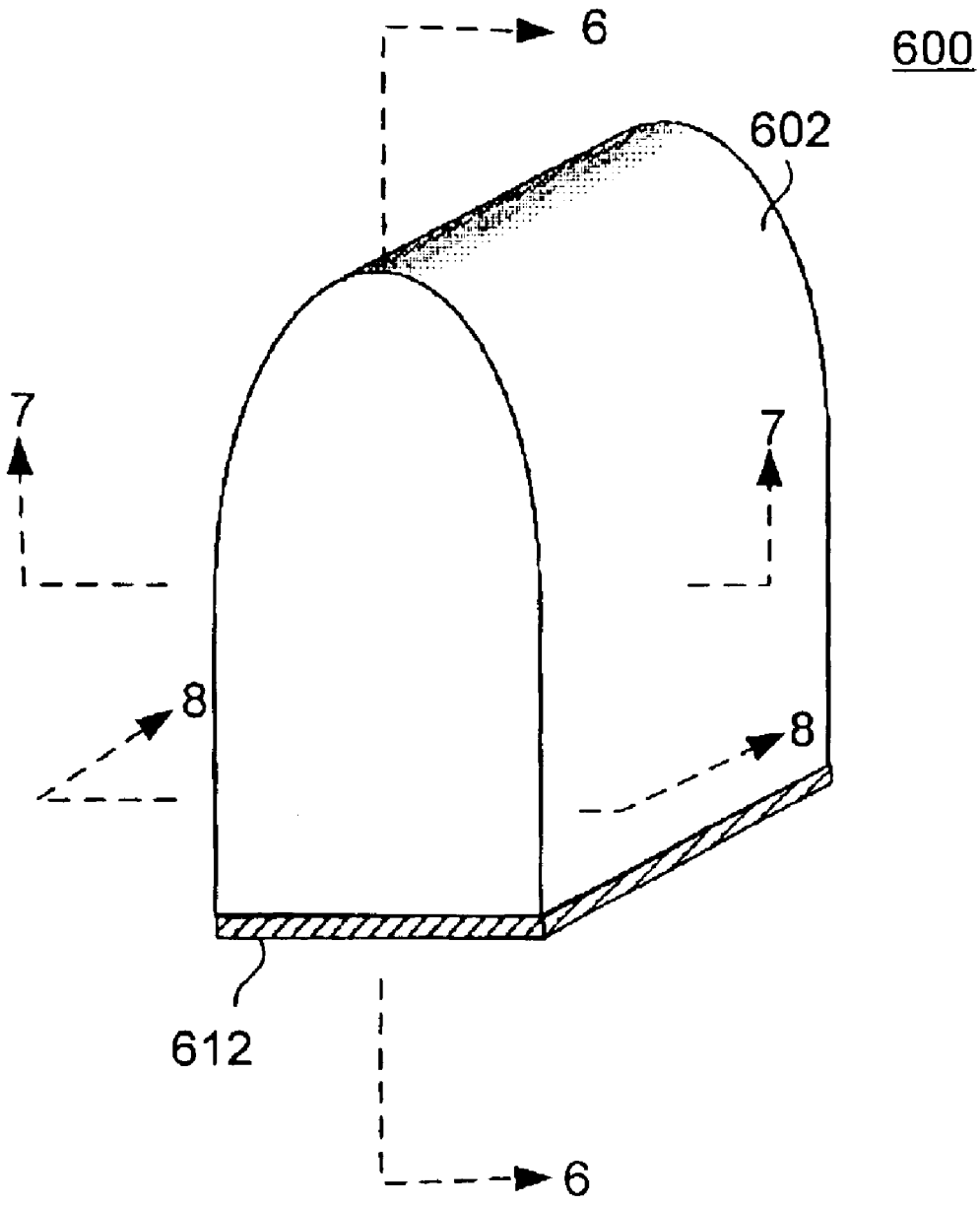
FIG. 5 is a 3-dimensional view of an FWT antenna in accordance with an embodiment of the invention.

In addition to using a three-dimensional, shaped dielectric (or other substance) to integrally encompass the antenna, energy shaping and gain can be further enhanced using a reflective base 612 (see FIGS. 5, 6, and 8). Such a reflective base 612 can be formed from any conductor, e.g., copper, aluminum, galvanized steel, or even semi-conductor materials in some embodiments. In one embodiment the reflective base is included on a printed circuit board that includes the reflector as well as other elements, such as filters, switches, pre-amps, chip sets, wires, integrated circuits, or other electronic elements. In another embodiment, the antenna is actually encompassed within a circuit board as the encompassing substance, which board is usually made of phenolic or fiberglass (although other substances are also suitable), which board is also used to hold various circuitry, and which board is coated on one side with a reflective material.

Figure 12:
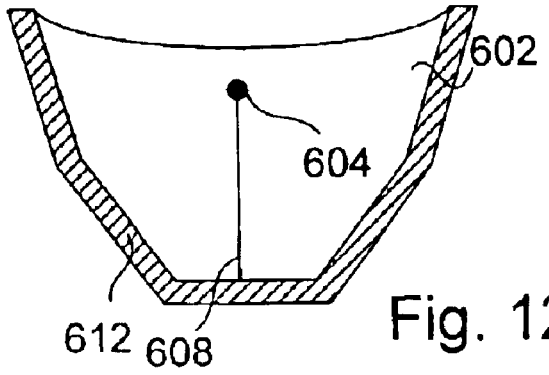
FIG. 12 is a side cutaway view of an FWT antenna in accordance with an embodiment of the invention having a shaped reflector.
Figure 13:
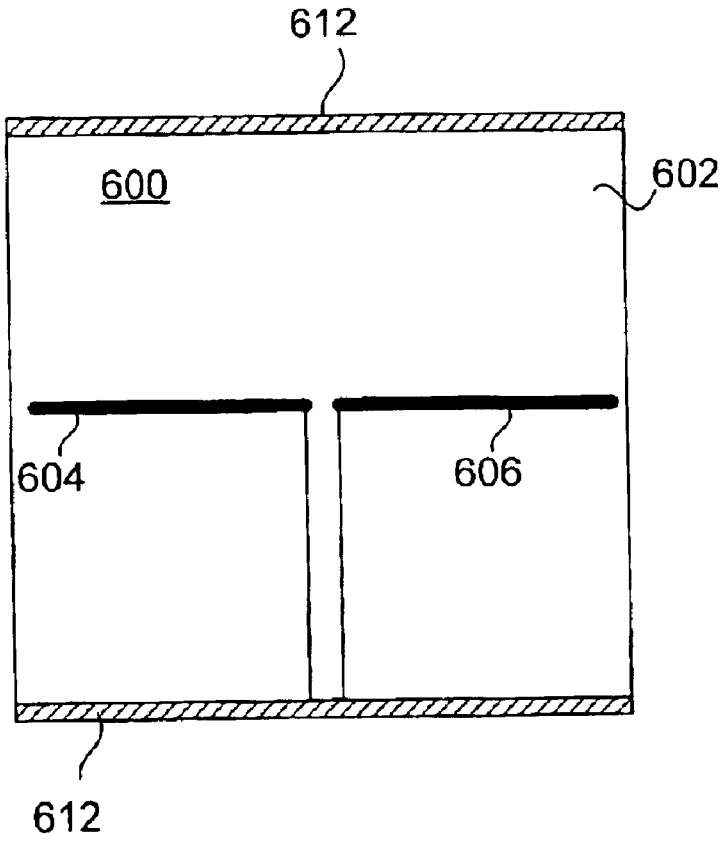
FIG. 13 is a front cutaway view of an FWT antenna in accordance with an embodiment of the invention having two reflectors (also called a split reflector)

Moreover the reflective base can vary in shape in order to further enhance gain and directivity, for instance, extending up the sides of a shaped dielectric (see FIG. 12). Several reflective surfaces or shaped reflectors could even be used in some embodiments. For instance, FIG. 13 shows a split reflector, having reflectors placed on both the top and the bottom surfaces of the dielectric, which could create a desirable radiation pattern from the sides of the structure.

Figure 10A:
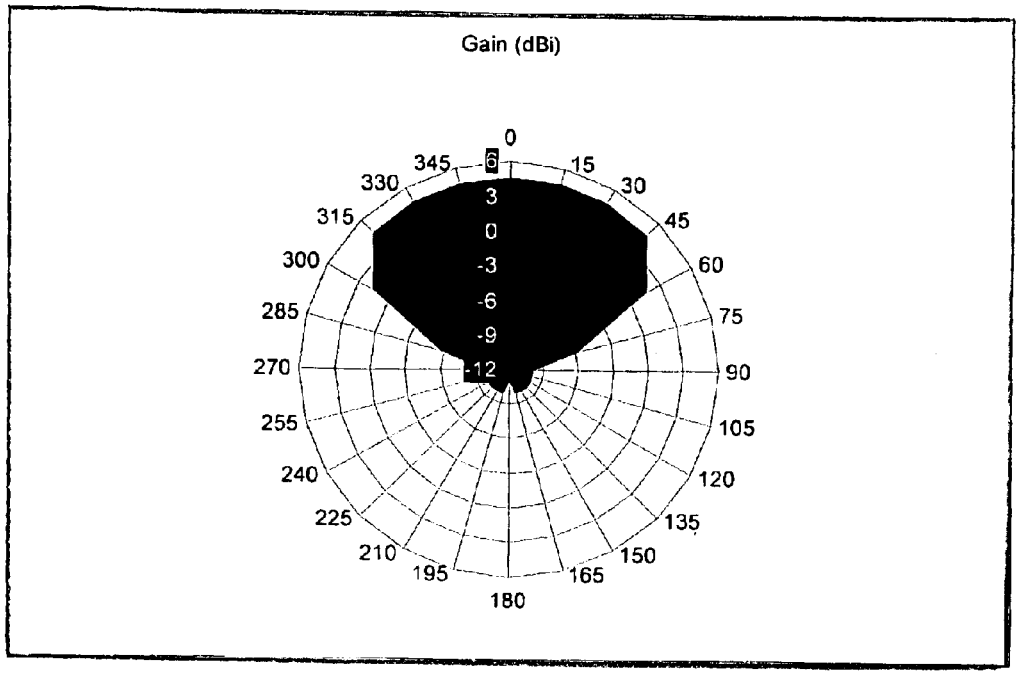
FIG. 10A illustrates a radiation pattern from an FWT antenna in accordance with an embodiment of the invention where the antenna is normal to the page.
Figure 10B:
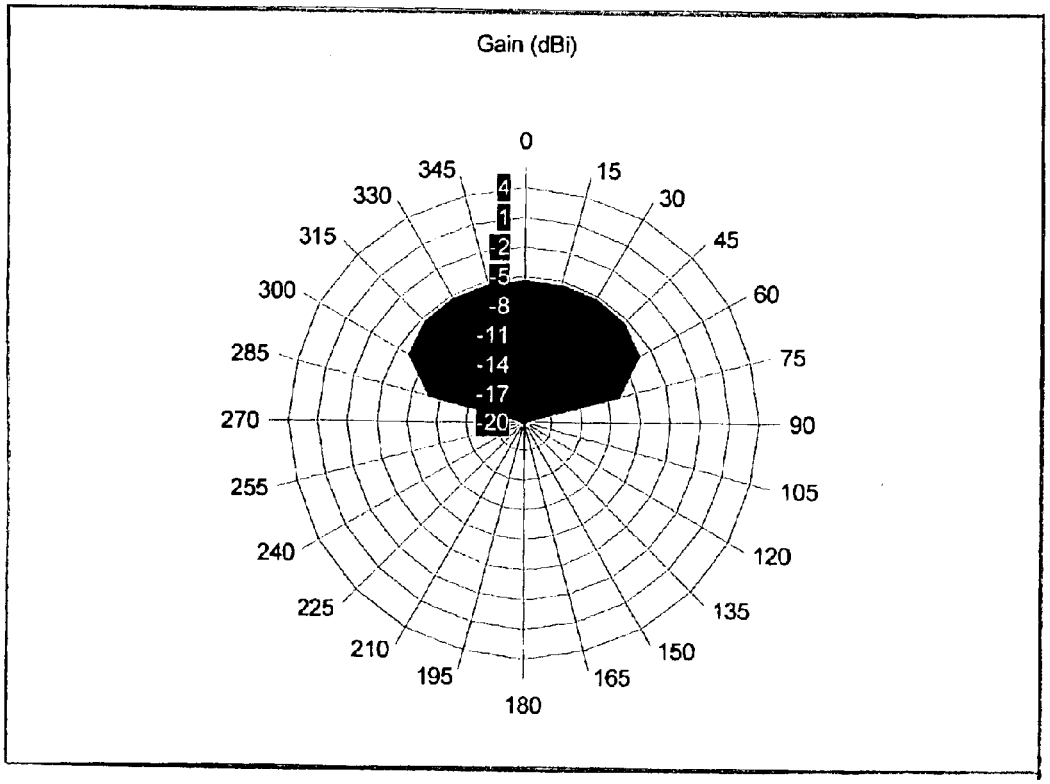
FIG. 10B illustrates a radiation pattern for a non-FWT antenna having similar dimensions to that for FIG. 10A, and where the antenna is normal to the page.

Using an antenna as shown in FIGS. 5–8 may result in a pattern similar to FIG. 10A in some embodiments. FIG. 10A shows the radiation pattern for an FWT device with a reflector having the dimensions of 30×30×15 mm, $\in_R$=4, and f=2.45 GHz where the dipole is normal to the page. In this embodiment, the width was compromised by λ/4 (15 mm) to make the device smaller, resulting in more rear leakage in the radiation pattern but minimal change in focused gain. FIG. 10B shows a radiation pattern for a similarly sized dipole antenna, but where it is not encompassed in a substance such as silicone, so $\in_R$=1. As can be seen, the radiation pattern in FIG. 10B is less desirable, having a wider beam and a lower gain. In order to achieve the results of FIG. 10A in a non-FWT device, the dimensions would generally be 60×60×30 mm.

Figure 11A:
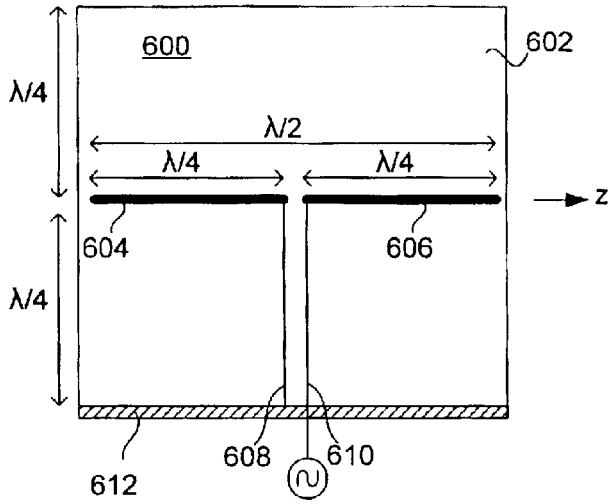
FIGS. 11A–C are a front cutaway view, a top cutaway view, and a side cutaway view, respectively, of an FWT antenna in accordance with an embodiment of the invention having a concave shape.
Figure 11B:
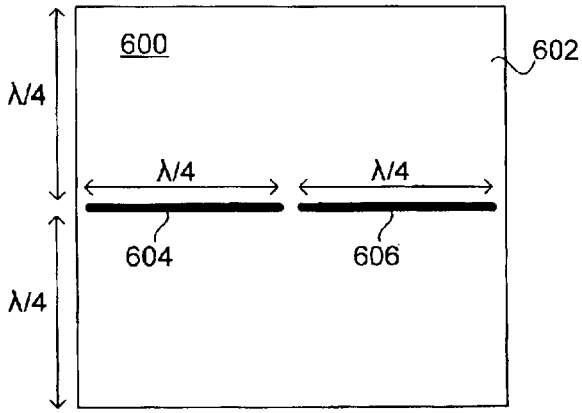
Figure 11C:
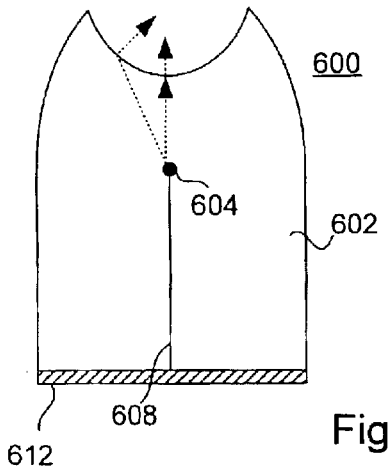

In accordance with an embodiment of the invention, FIGS. 5–8 illustrate an antenna integrally encompassed in a dielectric having a convex shape. However, as discussed above, in other embodiments, the dielectric can take on a variety of shapes. FIG. 11 illustrates a dielectric having a concave shape. As can be seen from FIGS. 11A, 11B, and 11C, the structure of the device remains similar to that shown in FIGS. 5–8 with the exception of the shape of the dielectric. As shown, and similar to the optical ray focusing effect discussed with respect to FIGS. 5–8, a dielectric having a concave shape will focus energy based on the reflection and refraction of the radiated waves at the dielectric/air interface, while a convex shape tends to follow a more dispersive radiation pattern.

FIG. 12 shows the same con,cave shape as in FIG. 11, but illustrates a shaped reflector encasing the sides of the dielectric. FIG. 13 illustrates another shaped reflector—a split reflector.

Most antennas radiate best when the elements of the antenna are energized with a balanced differential electrical signals, i.e., the current on each transmission line moves relative to the other with the same amplitude but 180 degrees out of phase. Usually such differential driving is difficult to achieve and requires the use of a transformer, transmission lines, or an active 180 degree drive circuit. Nonetheless, when using a λ/4 length transmission line, such a differential drive current can be achieved by driving only one line, as is known in the art. Because the dipole is spaced λ/4 from the reflective base in one embodiment in order to achieve enhancements to gain derived from those reflections, the λ/4 length of the transmission lines is inherent and internal to the construction of an antenna in accordance with the embodiment of the invention. Such differential driving is shown in FIG. 6 where line 610 is coupled to a current source 614 while line 608 is coupled to the reflective base 612 or ground.

Although the above-described embodiments are described with reference to a dipole antenna, the invention is not so limited, and various embodiments may have different antenna styles including a PIFA, planar array, parabolic dishes, loop antennas, phased arrays, biconic antennas, patch antennas, spirals, or any other antenna shape.

Figure 14:
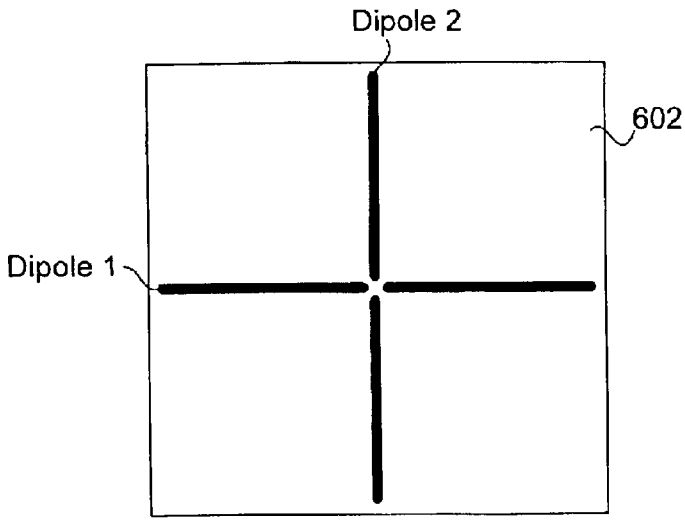
FIG. 14 is a top cutaway view of an FWT device in accordance with an embodiment of the invention including a plurality of dipole antennas.
Figure 15A:
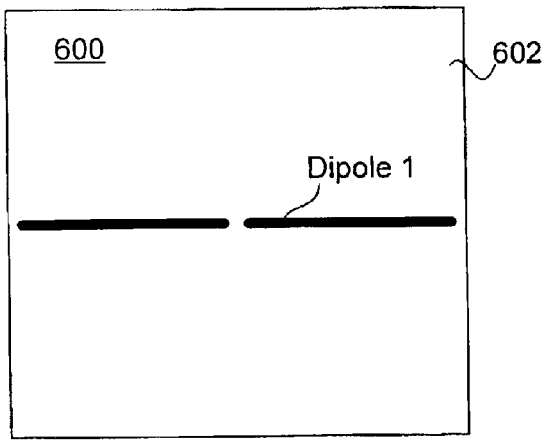
FIGS. 15A and 15B are a top cutaway view and a front cutaway view, respectively, of an FWT device in accordance with another embodiment of the invention also including a plurality of dipole antennas.
Figure 15B:
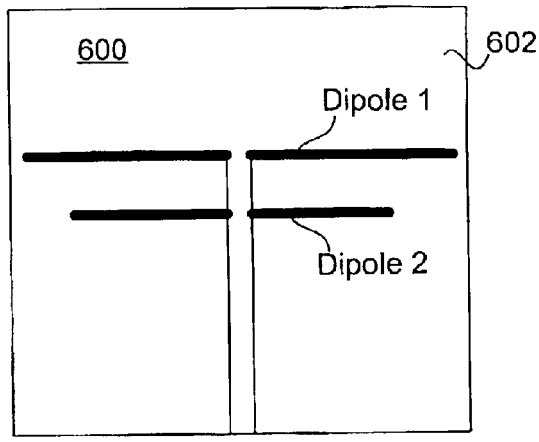

In addition, the use of a plurality of antennas in a variety of different arrangements within the dielectric may be useful in some embodiments. For instance, referring to FIG. 14, a top view of a device in accordance with an embodiment of the invention is shown depicting the use of two dipole antennas arranged perpendicular to each other to form a "cross." While larger than a single dipole, such an arrangement will produce a radiation pattern in two direction s ("horizontal" and "vertical"). Another arrangement of antennas in accordance with another embodiment is shown in FIGS. 15A and 15B, a top cutaway view and a front cutaway view, respectively. FIGS. 15A and 15B show two dipole antennas stacked, where the dipoles can have differing lengths in some embodiments. Such an arrangement offers a multi-frequency device, e.g., 1800 MHz on dipole 1 and 2100 MHz on dipole 2.

Still other arrangements of multiple antennas may include an array within a single dielectric. Other embodiments may form an array using a plurality of individually encompassed antennas. In either case, the array size will be reduced as a result of the reduced A, since the spacing amongst the array antennas, which spacing is based on A, will also be reduced as will be understood in the art.

In accordance with an embodiment of the invention one embodiment of an antenna is used in the 2.4 GHz frequency band, the band used by a variety of popular communication protocols such as Bluetooth, IEEE 802.11, and others. Traditionally, high-performance antennas in this band would have the dimensions of 100×200×50 mm. Nonetheless, an FWT antenna in accordance with the embodiment with the invention using silicone as a dielectric and having a similar performance as the 100×200×50 mm non-FWT antenna can be made with dimensions of 35×40×25 mm. Moreover, antennas in accordance with the embodiments of the invention can be built to support any ISM frequency, and at least 800–6000 MHz, although other frequency ranges may also be used with various embodiments of the invention.

Although altering the permittivity constant $\in_R$ has primarily been discussed above for the various embodiments of the invention, it should be recognized that varying the permeability constant $\mu_R$ by using a material with a different $\mu_R$ to that of air could also be used to create an antenna that varies the wavelength and has similar effects as when $\in_R$ is modified.

It should also be recognized that while various embodiments of the invention have been described with respect to transmission of signals, the same principles apply to reception of signals.

Finally, although the embodiments described above are wholly encompassed within a dielectric, various embodiments of the invention having a partially encompassed antenna will also be useful.

Accordingly, an antenna has been described that creates a high radiation gain and directivity while remaining significantly smaller relative to its conventional counterparts, thereby increasing communication range. The resulting antenna will be useful in portable systems as well as tower mounted antennas, antenna arrays, or other antennas. Because of the smaller size of various embodiments of the invention, various uses and benefits will be understood by those of skill in the art, including that spatial resolution can be enhanced by use of FWT devices since more FWT devices can occupy the same real estate as fewer non-FWT devices.

It should be understood that the particular embodiments described above are only illustrative of the principles of the present invention, and various modifications could be made by those skilled in the art without departing from the scope and spirit of the invention. Thus, the scope of the present invention is limited only by the claims that follow.

What is claimed is:

1. A device for radiating to a medium or receiving from the medium, a signal having a predetermined wavelength in the medium, comprising:

a body of a substance in which an antenna is encapsulated, and in which the wavelength $\lambda$ of the signal is less than in the medium, wherein a surface of the body forms a signal lens that directs energy of a signal according to an intended radiation or sensitivity pattern, wherein the antenna is a dipole with arms of approximately $\lambda/4$ in length in the substance, wherein the body has a pair of opposite sides, a pair of opposite ends, a top, and a bottom, and wherein the dipole extends between the ends of the body and is spaced from the sides and the top and bottom of the body by wavelength dimensions of about $\lambda/8$ to about $3\lambda/8$ in the substance.

2. A device according to claim 1, wherein the lens is convex.

3. A device according to claim 1, wherein the lens is concave.

4. A device according to claim 1, wherein the substance has a dielectric constant between about 2 and about 10.

5. A device according to claim 4, wherein the substance is silicone having a dielectric constant of about 4.

6. A device according to claim 1, wherein the wavelength dimensions of the body are approximately $\lambda/2\times\lambda/2\times\lambda/2$.

7. A device according to claim 1, wherein the dipole has leads of approximately $\lambda/8$ to $3\lambda/8$ in length in the substance for transmitting a signal to or from the dipole.

8. A device according to claim 1, wherein the lens is at the top of the body and the bottom of the body is formed with a reflector.

9. A device according to claim 1, wherein the substance has at least one of permittivity and permeability that differs from that of the medium.

10. A device according to claim 1, wherein the body contains at least one additional antenna.

11. A device according to claim 10, wherein the additional antenna is parallel to or perpendicular to the dipole.

* * * * *